United States Patent [19]

Thorn

[11] Patent Number: 4,864,789

[45] Date of Patent: Sep. 12, 1989

[54] COMPRESSION MOLDED DOOR ASSEMBLY

[75] Inventor: John E. Thorn, Sylvania, Ohio

[73] Assignee: Therma-Tru Corp., Toledo, Ohio

[21] Appl. No.: 201,448

[22] Filed: Jun. 2, 1988

[51] Int. Cl.[4] ..... E04C 2/20

[52] U.S. Cl. ..... 52/309.9; 52/455

[58] Field of Search ..... 52/455–458, 52/208, 803, 805, 813, 815, 309.9; 49/501

[56] References Cited

U.S. PATENT DOCUMENTS

| | | | |
|---|---|---|---|
| 678,903 | 7/1901 | Rapp | 52/803 |
| 2,849,758 | 9/1958 | Plumley et al. | 52/309.15 |
| 2,871,056 | 1/1959 | Levitt | 49/501 |
| 2,890,977 | 6/1959 | Bayer et al. | 52/824 |
| 2,924,860 | 2/1960 | Parham, Jr., et al. | 49/501 |
| 3,153,817 | 10/1964 | Pease, Jr. | 52/802 |
| 3,225,505 | 12/1965 | Lytz | 428/201 |
| 3,250,041 | 5/1966 | Anger | 49/501 |
| 3,299,595 | 6/1967 | Munk | 52/309.13 |
| 3,402,520 | 9/1968 | Lee et al. | 52/309.6 |
| 3,498,001 | 3/1970 | MacDonald | 49/501 |
| 3,512,304 | 5/1970 | Meuret | 49/501 |
| 3,546,841 | 12/1970 | Smith et al. | 52/309.11 |
| 3,593,479 | 7/1971 | Hinds et al. | 52/313 |
| 3,772,241 | 11/1973 | Kroekel | 523/523 |
| 3,883,612 | 5/1975 | Pratt et al. | 525/170 |
| 3,950,894 | 4/1976 | DiMaio | 49/501 |
| 3,961,012 | 6/1976 | DiMaio | 264/257 |
| 4,132,042 | 6/1979 | DiMaio | 52/309.1 |
| 4,152,876 | 5/1979 | Seely | 52/455 |
| 4,265,067 | 5/1981 | Palmer | 52/455 |
| 4,550,540 | 11/1985 | Thorn | 52/456 |
| 4,720,951 | 1/1988 | Thorn | 52/455 |

FOREIGN PATENT DOCUMENTS

| | | | |
|---|---|---|---|
| 898855 | 5/1984 | Belgium | 52/455 |
| 2304763 | 11/1976 | France . | |
| 604937 | 1/1978 | U.S.S.R. . | |
| 1420244 | 1/1976 | United Kingdom . | |
| 1487309 | 9/1977 | United Kingdom . | |
| 2044316 | 10/1980 | United Kingdom . | |

*Primary Examiner*—James L. Ridgill, Jr.

*Attorney, Agent, or Firm*—Emch, Schaffer, Schaub & Porcello Co.

[57] ABSTRACT

A compression molded door assembly is disclosed. A rectangular frame is not required. The edges of the opposed door skins include integral mating edge members over at least a portion of the side edges. A vertical stile may be positioned along another edge.

12 Claims, 2 Drawing Sheets

COMPRESSION MOLDED DOOR ASSEMBLY

BACKGROUND OF THE INVENTION

The present invention relates to a compression molded door assembly. Compression molded door assemblies comprise a separate class of doors. A prior art compression molded door assembly is disclosed in my U.S. Pat. No. 4,550,540, which was granted Nov. 5, 1985.

Compression molded door assemblies include outer compression molded door skins which have a textured pattern on the outer side of each skin which simulates, for example, grain and texture of a wood door.

The compression molded door assemblies are often superior to a wood door in that they have dimensional stability which resists excessive deflection and warping caused by temperature and humidity differentials.

SUMMARY OF THE INVENTION

The present invention is directed to a compression molded door assembly which does not include a rectangular frame found in most prior art compression molded doors.

The outer sides of the compression molded skins define a textured pattern simulating the grain and texture of a wood door. An integral edge member extends outwardly from at least a portion of the side edges of the door skins. The integral edge member mates with a similar integral edge member extending outwardly from the opposed compression molded skin.

Often, at least one vertical stile member is positioned on one edge of the opposed skins and is held in place by a vertical stop which is spaced inwardly of the door edge. The vertical stile member engages the vertical rib stop and means are provided for retaining the stile member against the rib stop.

The primary object of the present invention is to provide a compression molded door assembly that is both attractive and also has strength and dimensional stability.

DETAILED DESCRIPTION OF THE DRAWINGS

DETAILED DESCRIPTION OF THE PREFERRED EMBODIMENTS

Figure 1:
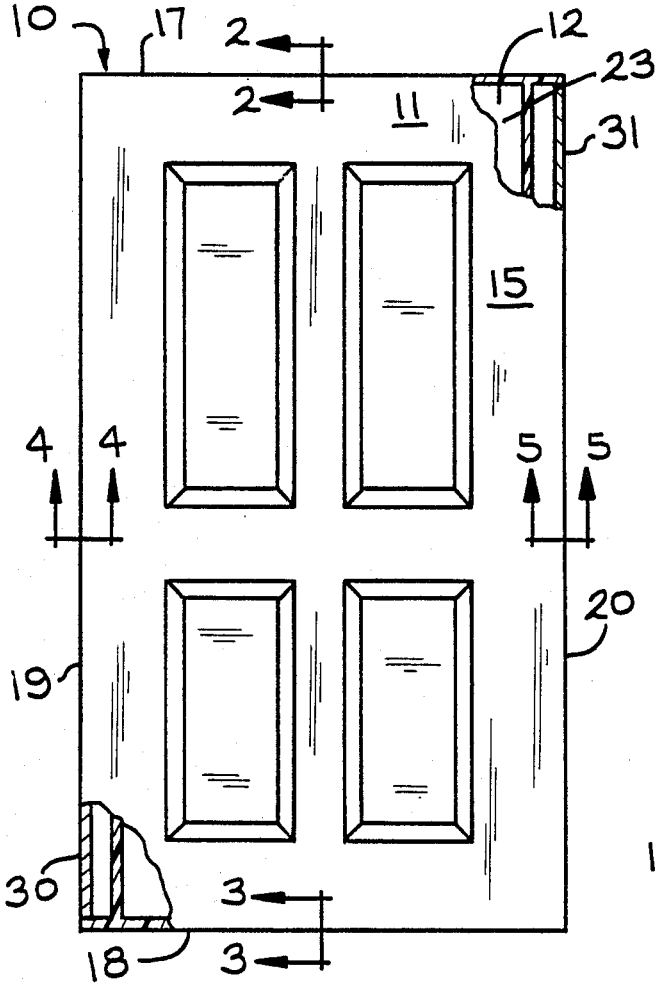
FIG. 1 is an elevational view of a compression molded door assembly, according to the present invention, and having a portion of the door skins removed in the corners to show the interior of the structure.

A compression molded door assembly, according to the present invention, is generally indicated by the reference number 10 in FIG. 1. The compression molded door assembly 10 includes a pair of opposed compression molded door panels or skins 11 and 12. The interior of door assembly 10 is often filled with a foamed core 13.

Each of the skins 11, 12 is a compression molded sheet molding compound (SMC) panel which includes 15% to 40% fibrous glass reinforcement, by weight, and 10% to 40% inert material filler, by weight, in the molding resin. Unsaturated polyester polymers blended with vinyl monomers such as styrene are molding resins that may be cured under heat and pressure form the thermoset compression molded skins. The molding resins include unsaturated polyester resin compositions and modifications as disclosed in, for examples, U.S. Pat. Nos. 3,772,241 and 3,883,612.

The inert filler may be, for examples, calcium carbonate or aluminum trihydrate. In some embodiments, the material may also include ultraviolet stabilizers and fire retardant additives in the composition.

Each of the skins 11, 12 has a thickness of between 0.050 inch and 0.120 inch. The present embodiment shown in FIG. 1 has a skin thickness of 0.070 inch.

Figure 2:
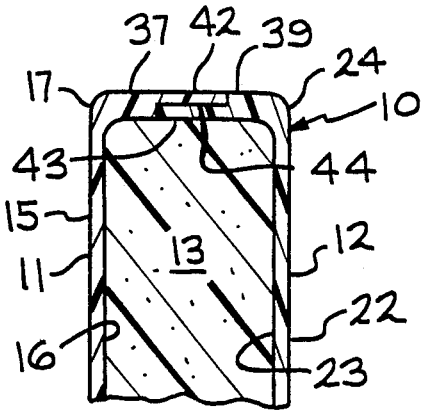
FIG. 2 is a fragmentary, cross-sectional view taken along the line 2—2 of FIG. 1.

Referring to FIGS. 1 and 2, the compression molded skin 11 has an outer side 15, an inner side 16, top and bottom edges 17, 18 and opposed side edges 19, 20.

Similarly, the compression molded skin 12 has an outer side 22, an inner side 23, a top edge 24, a bottom edge 25 and side edges 26, 27.

The outer sides 15 and 22 of the skins 11 and 12 include a molded wood grain texture. The texture is important and simulates from a texture viewpoint and a graining viewpoint a wood door. The texture on the outer sides 15 and 22 is between 0.003 inch and 0.009 inch in depth. The outer sides 15 and 22 of the skins 11 and 12 are essentially devoid of glass fibers for a predetermined depth of at least 0.005 inch. This predetermined depth, where the outer sides 15 and 22 are essentially devoid of glass fibers, is normally between 0.005 inch and 0.009 inch.

While the inner sides 16 and 23 of the skins 11 and 12 may also have a defined pattern or random texture molded into the skin, this is not essential to the invention. In some cases, the texture provides an adhering surface if an adhering foam core is utilized.

Referring to FIGS. 1–5, in the embodiment shown, a rectangular wooden or other rectangular frame is not provided. In the present embodiment, a pair of opposed vertical stile members 30 and 31 are positioned between the compression molded skins 11 and 12. The stile members 30 and 31 in the present embodiment are generally U-shaped and are constructed of a polyvinyl chloride (PVC) material. However, other types of vertical stile members may be utilized, including wood stiles aluminum extrusions, other metallic stiles and other types of extruded or formed plastic materials.

Figure 4:
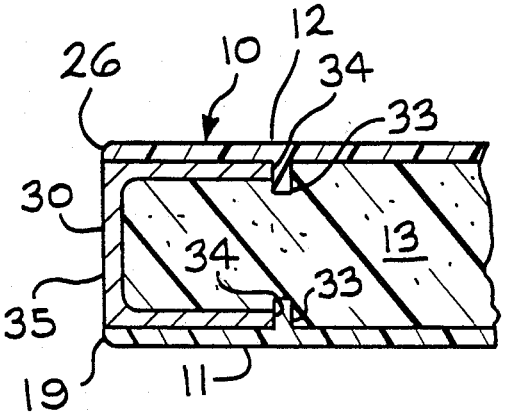
FIG. 4 is a fragmentary, cross-sectional view taken along the line 4—4 of FIG. 1.
Figure 5:
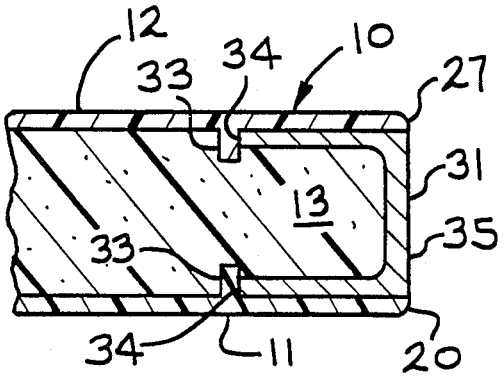
FIG. 5 is a fragmentary, cross-sectional view taken along the line 5—5 of FIG. 1.

Referring to FIGS. 4 and 5, vertical stops 33 are spaced inwardly from the edges 19, 20 and 26, 27 of the skins 11 and 12. In the present embodiment, the stops are integrally formed with the respective skins 11 and 12 and are also vertically continuous. However, in other embodiments (not shown), the stops 33 are merely adhered to the inner walls of the skins and may be either vertically continuous throughout the height of the door or, in the alternative, be a vertical series of discontinuous stop members.

In the present embodiment, the vertical stop members 30 and 31 include cooperating edges 34 which mate with and actually engage the vertical stops 33 to hold outer surfaces 35 of the vertical stile members 30, 31 in correct vertical alignment with the side edges 19, 26 and 20, 27 of the compression molded skins 11 and 12.

Figure 3:
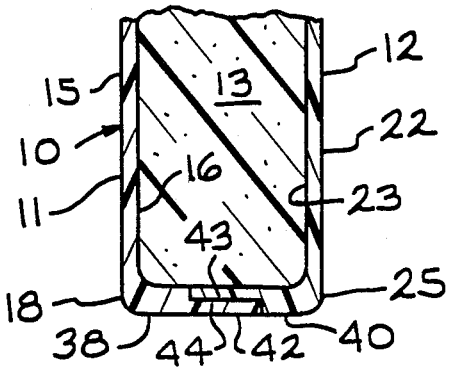
FIG. 3 is a fragmentary, cross-sectional view taken along the line 3—3 of FIG. 1.

Referring to FIGS. 1, 2 and 3, the present compression molded door assembly 10 does not include standard upper frame members or rails. Rather, integral edge members 37 and 38 extend outwardly from the top edge 17 and the bottom edge 18 of the door skin 11. Similarly, integral edge members 39–40 extend outwardly from the top edge 24 and the bottom edge 25 of the compression molded door skin 12. Tongues 42 are provided on the outer edges of the edge members 37 and 38 of the door skin 11 while mating tongues 43 are provided on the outer edges of the edge members 39 and 40 of the door skin 12. In this embodiment the mating tongues 42 and 43 form a lap joint and are normally adhered together by an adhesive layer 44 at such lap joint.

In another embodiment of the present invention (not shown), rather than having the mating edge members only to the top and bottom edges of the door skins, the mating edge members are provided on all four edges of the door skins. In such an embodiment, the vertical stiles are not present, however short vertical members are provided at the hinge and lock set locations on the door side edges.

Figure 6:
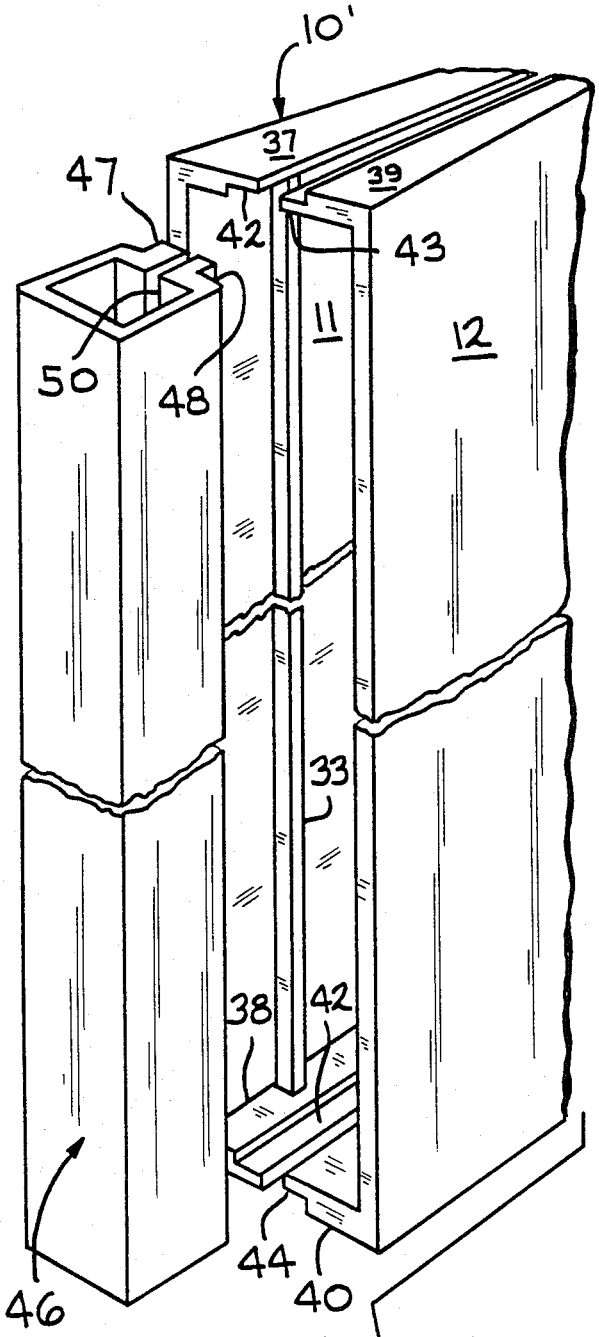
FIG. 6 is a fragmentary, exploded view of one embodiment of the present invention and showing a vertical stile member.
Figure 7:
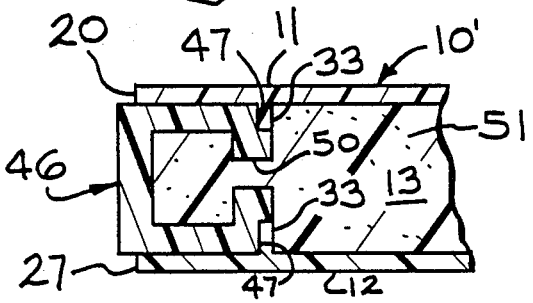
FIG. 7 is a fragmentary, cross-sectional view of the FIG. 6 embodiment after assembly.

Another embodiment of the invention is shown in FIGS. 6 and 7. In this embodiment, another form of vertical stiles member 46 is utilized. This stile member is an extruded PVC style member which includes vertically extending recesses 47 and 48 which mate with the vertical stops 33 located on the inner sides 16 and 23 of the compression molded skins 11 and 12.

A vertical entrance throat 50 is defined by the vertical stile member 46. A foamed material 51 is positioned between the skins 11 and 12. The foamed material 51 also enters the vertical stile member 46 by way of the entrance throat 50 to form an overall unitary structure.

Figure 8:
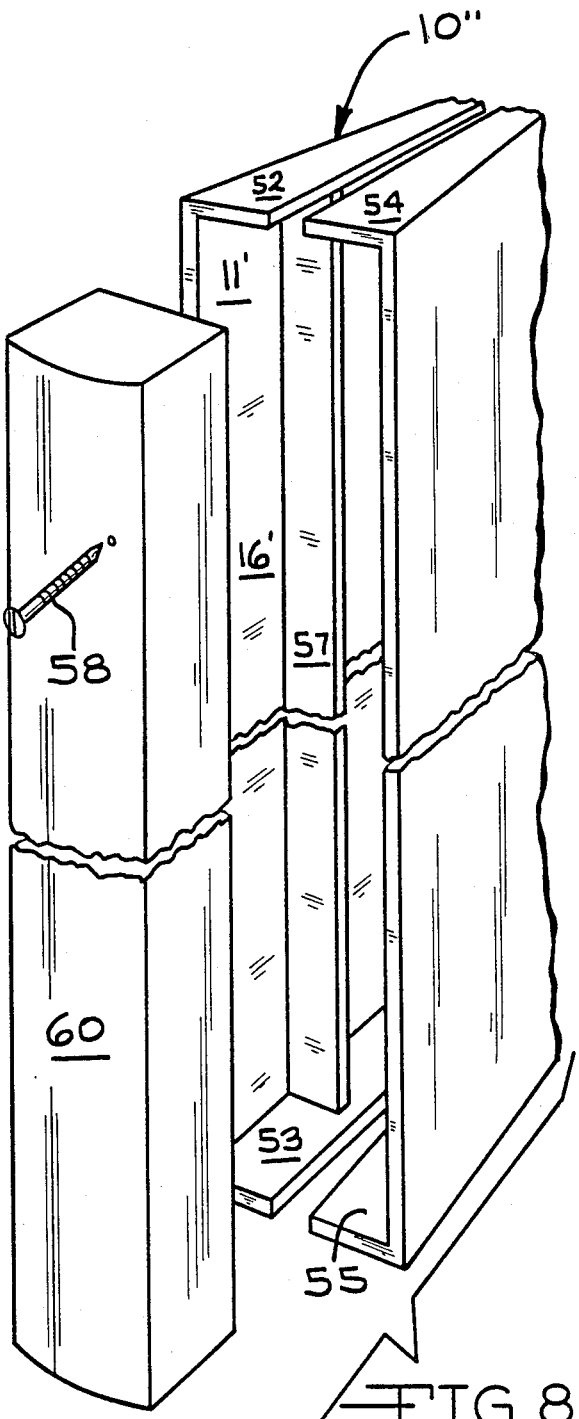
FIG. 8 is a fragmentary, exploded view of another embodiment of the present invention and showing another type of vertical stile member.
Figure 9:
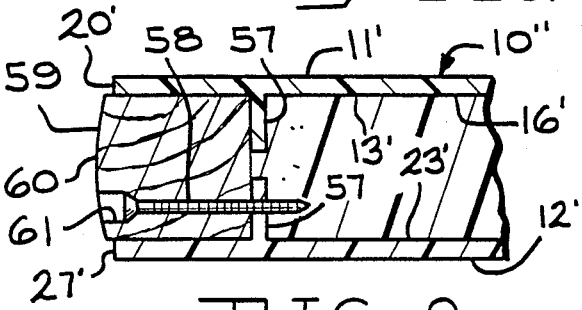
FIG. 9 is a fragmentary, cross-sectional view of the FIG. 8 embodiment after assembly.

Still another embodiment of the present invention is shown in FIGS. 8 and 9. In this embodiment a compression molded door assembly 10″ includes compression molded door skins 11′ and 12′. Integral edge members 52 and 53 extend outwardly from the compression molded door skin 11′. Similarly, integral edge members 54 and 55 extend outwardly from the compression molded door skin 12′. When the unit is fully assembled, the edge members 52 and 54 and the edge members 53 and 55 mate to form butt joints. A planar vertical stop member 57 extends along the inner wall 16′ of the door skin 11′ between the integral edge members 52 and 53. Similarly, a planar vertical stop member 57 extends along the inner side 23′ of the door skin 12′ between the integral edge members 54 and 55. A wooden vertical stile member 59 is positioned against the vertical stop members 57 and includes an outer surface 60 which is spaced slightly outwardly from the side edges 20′ and 27′ of the door skins 11′ and 12′. The outer surface 60 may be planed or otherwise adjusted in the field, if necessary. The vertical stile member 59 is held in place by a plurality of screw fasteners 58 which engage both the stile member 59 and one of the vertical stop members 57. While a screw recess 61 is shown in FIG. 9, this screw recess 61 is normally filled to give a pleasing appearance to the outer surface 60.

While the present invention has been disclosed with respect to specific embodiments, it is understood that various changes and modifications may be made to the compression molded door assembly without departing from the scope of the following claims.

What I claim:

1. A door assembly comprising, in combination, a pair of opposed compression molded skins, each of said skins having an outer side, an inner side, top and bottom edges and opposed side edges, said compression molded skins being integrally molded including resin and fibrous glass, said outer side of at least one of said skins defining a textured pattern simulating the grain and texture of a wood door, at least one vertical stile member positioned between said opposed compression molded skins at one of said side edges, said vertical stile member having upper and bottom ends which are not joined to a horizontal frame or rail member, and at least one vertical rib stop spaced inwardly from said inner edge of each one of said opposed compression molded skins, said vertical rib stops on said opposed skins extending toward one another and defining cooperating edges, said vertical stile member engaging said cooperating edges of said vertical rib stops to position said stile member relative to said edge of said skin and means for retaining said stile member in such position.

2. A door assembly, according to claim 1, wherein said vertical stile member comprises a PVC member.

3. A door assembly, according to claim 1, wherein said vertical stile member comprises an aluminum extrusion member.

4. A door assembly, according to claim 1, wherein said vertical stile member comprises a wood member.

5. A door assembly, according to claim 1, wherein said retaining means comprises an adhesive layer on said vertical stile member.

6. A door assembly, according to claim 1, wherein said retaining means comprises screw fastener which mates with said vertical rib stop.

7. A door assembly comprising, in combination, a pair of opposed compression molded skins, each of said skins having an outer side, an inner side, top and bottom edges and opposed side edges, said compression molded skins being integrally molded including resin and fibrous glass, said outer side of at least one of said skins defining a textured pattern simulating the grain and texture of a wood door, an integral edge member extending outwardly from at least a portion of said edges of one of said skins and mating with a similar integral edge member extending outwardly from said opposed skin and an insulating core positioned between the skins, whereby said door assembly does not include a continuous frame consisting of joined stile and rail members.

8. A door assembly, according to claim 7, wherein said integral edge members mate with a butt joint.

9. A door assembly, according to claim 7, wherein said integral edge members mate with a lap joint.

10. A door assembly, according to claim 7, wherein said mating integral edge members are present along at least three edges of said opposed skins.

11. A door assembly, according to claim 10, wherein a vertical stile member is positioned along a fourth edge of said opposed skins.

12. A door assembly comprising, in combination, a pair of opposed compression molded skins, each of said skins having an outer side, an inner side, top and bottom edges and opposed side edges, said compression molded skins being integrally molded including a molding resin and fibrous glass fibers, said outer side of each of said skins defining a textured pattern simulating the grain and texture of a wood door, an integral edge member extending outwardly from at least a portion of said edges of one of said skins and mating with a similar integral edge member exetnding outwardly from said opposed skin, at least one vertical stile member positioned along one edge of said opposed skins and a vertical stop means spaced inwardly of said one edge, said vertical stile member engaging said vertical rib stop means and means for retaining said vertical stile member against said vertical rib stop means, said vertical stile member having upper and bottom ends which are not joined to a horizontal frame or rail member.

* * * * *